US006168393B1

(12) United States Patent
Huber et al.

(10) Patent No.: US 6,168,393 B1
(45) Date of Patent: Jan. 2, 2001

(54) ELECTRIC MOTOR/RADIAL PUMP ASSEMBLY

(75) Inventors: Gerhard Huber, Frankenhofen; Klaus Stolle, Schwabniederhofen; Gisela Schleich, Schwabbruck, all of (DE)

(73) Assignee: Hoerbiger GmbH (DE)

( * ) Notice: Under 35 U.S.C. 154(b), the term of this patent shall be extended for 0 days.

(21) Appl. No.: 09/019,055

(22) Filed: Feb. 5, 1998

(30) Foreign Application Priority Data

Feb. 5, 1997 (AT) ..... 179 97

(51) Int. Cl.[7] ..... F04B 17/00
(52) U.S. Cl. ..... 417/360; 417/415
(58) Field of Search ..... 417/360, 415

(56) References Cited

U.S. PATENT DOCUMENTS 1,983,262 * 12/1934 Zorzi ..... 103/118
3,719,429 * 3/1973 Rule ..... 415/201
4,416,594 * 11/1983 Ichikawa ..... 417/360
4,523,899 * 6/1985 Ouchi ..... 417/360
4,627,793 * 12/1986 Kuroyanagi et al. ..... 417/203
4,925,373 * 5/1990 Moate ..... 417/372

* cited by examiner

*Primary Examiner*—Timothy S. Thorpe
*Assistant Examiner*—Timothy P. Solak
(74) *Attorney, Agent, or Firm*—Dykema Gossett PLLC

(57) ABSTRACT

A motor-driven radial piston pump assembly has its radial piston pump supported by a base section on one side thereof which likewise supports an electric motor for powering the pump which is supported on that same side coaxially. The electric motor and a hydraulic tank are directly connected to the base section, the motor being surrounded by a cylindrical-shaped motor housing forming an inner wall of the tank and being sealingly connected to the base section, the motor housing being closed by a cover on its outer end opposite the pump. Such arrangement is compact in that the electric motor is simply positioned directly on the base section and is almost completely surrounded by the hydraulic tank such that the separate motor housing of the electric motor can be of simple and light weight construction.

16 Claims, 1 Drawing Sheet

ELECTRIC MOTOR/RADIAL PUMP ASSEMBLY

BACKGROUND OF THE INVENTION

This invention relates to an electric motor/radial pump assembly which includes a base section that contains a radial piston pump together with its hydraulic connecting lines and control elements, an electric motor being operatively connected to the pump and being supported on one side of the base section coaxially with respect to the central axis of a pump output shaft, and a hydraulic tank being supported on the one side of the base section coaxial to that central axis.

Such assemblies have been known and are used with increasing frequency for transportable purposes or for generating small forces, for example, for the hydraulic activation of motor vehicle folding canopy tops, the movement of medical treatment chairs, tables, etc. Thus the main requirement is that the assembly be as small as possible which, with respect to operating cylinders and lines that must be manipulated, includes all relevant components in order that the construction and maintenance be as simple and efficient as possible.

A motor-driven radial piston pump assembly for hydraulic uses is disclosed in German document C3 32 27 926 in which the base section supports the pump and the hydraulic tank on one side and on the other side thereof the sealed, encapsulated motor for the pump is supported such that the remaining inner space in the motor housing is used as an oil tank via a connection opening in the base section. However, with such an arrangement, a relatively expensive so-called sub-oil motor is required such that the attachment of the assembly above the center of the supporting base section causes problems in many applications.

A radial piston pump assembly of the aforedescribed type is also disclosed in European published application A1 0 628 720 in which a cylindrical shaped tank for the hydraulic medium is coaxial with the base section and is secured directly thereto, and wherein the electric motor for operating the pump is coaxial with the tank and is secured directly thereto at a side opposite the side at which the tank is secured to the pump. The entry area of the motor shaft into the tank is sealed so that the motor itself is located outside and need not be specially constructed. However, this presents a disadvantage in that an elongated motor shaft for operating the pump must extend through the tank and that the tank is located between the motor and the base section and supports the motor such that the tank must be constructed of relatively stiff and heavy material.

OBJECT OF THE INVENTION

It is therefore an object of the present invention to provide an improved motor-driven radial piston pump assembly of generally the aforedescribed type in a manner that the noted disadvantages can be avoided while at the same time a compact construction is effected in a simple manner with a secure, and light weight mounting of the electric motor for the pump.

The motor-driven radial piston pump assembly according to the invention has its electric motor directly connected to the base section and includes a substantially cylindrical-shaped motor housing that surrounds the motor and is sealed and connected to the base section, the motor housing forming an inner wall of the hydraulic tank, and the housing being closed by a cover on an outer end thereof opposite the pump. With such an arrangement the base section bears the reaction forces and the weight of the motor and transmits those forces directly on the base section which also supports the pump, thereby effecting a very compact construction. The tank essentially surrounds the motor, which is maintained dry by the motor housing, for its entire length, so that a very compact construction results which in most cases is significantly lighter than the construction requirements set for the specific use of the assembly. There is no requirement for the additional expense of a sub-oil motor which would render the assembly unusable for those applications in which price plays a primary role. There is the added advantage of excellent noise insulation for the motor because it is surrounded by the cylindrical-shaped motor housing, the volume of the tank, and the outer covering forming the outer wall of the tank, so that applications are also possible in which such an assembly can now be used in those areas demanding additional sound insulation.

The base section of the assembly according to the invention serves as a pump receptacle for the pump together with its connecting lines and control elements, the base section including a pump support and a separate support flange secured to the electric motor, to the motor housing and to the hydraulic tank. Thus the essential components of the base section are divided according to function—the supporting elements for the motor and tank are combined in the support flange on which the pump support with the hydraulic components is placed on the outer side in relation to the tank and secured from the inside. Thus, if required, the support flange and the pump support can be of different materials such that simple replacement is possible. Also, the assembly can be constructed with pump supports for different pressures, different volumetric displacement and the like.

The motor housing according to the invention is connected to the base section and is sealingly secured to the outer periphery of a cylindrical-shaped projection of the support flange, the motor shaft passing through a central opening provided in such projection. This facilitates a simple construction which again makes possible, if needed, various materials to be used for the support flange and the cylindrical-shaped motor housing.

Further according to the invention the hydraulic suction line for the pump includes a suction pipe extending into the tank and a feeder line located in the pump support, the suction pipe being supported by the support flange so as to establish communication between the feeder line and the tank. The suction pipe can be constructed or positioned according to the actual attachment conditions of the assembly, so that the functioning of the hydraulic pump can be assured without changes required on the pump housing.

The cover for closing the one end of the motor housing may be formed integrally with the motor housing, or may be formed as a separate part.

A covering defines an outer wall of the hydraulic tank and supports the motor housing in surrounding sealed engagement therewith adjacent the cover which closes the outer end of the housing such that the covering can be of a one-piece construction resulting in a simple, leak-proof arrangement of the inner space of the motor housing for the electric motor.

The assembly may comprise an interference element and/or a temperature safeguard element for the electric motor located inside of the motor housing on a side opposite the base section. These elements can then be advantageously placed directly on or in the vicinity of the electric motor without forming any other obstacles.

The external covering is sealingly and removably connected to the support flange about an outer periphery thereof, such that the interior of the tank and the motor housing are easily accessible.

The motor housing can be of metal and the hydraulic tank cover of plastic materials. A metallic motor housing thus enhances improved heat transfer from the motor to the tank and provides improved EMV protection. The lighter plastic hydraulic tank covering provides a lighter and simpler construction, since the tank does not support other than its own weight and can also be simply sealed, as aforedescribed, against the cylindrical-shaped motor housing and thus supported on the side opposite the base section.

DETAILED DESCRIPTION OF THE INVENTION

Figure 1:
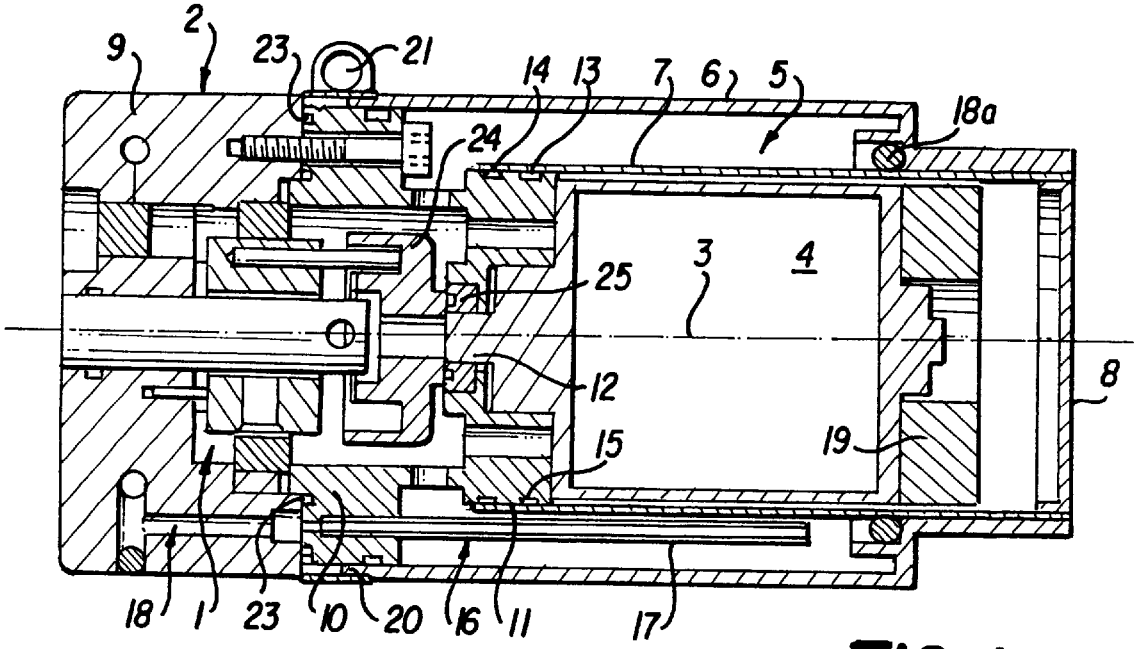
FIG. 1 is a schematic, vertical sectional view of the motor-driven radial piston pump assembly according to the invention.

The motor-driven radial piston pump assembly according to the invention is shown in detail in FIG. 1 as comprising a radial piston pump generally designated 1 which includes its hydraulic connecting lines and control elements (not shown) which are known in the art. For further details of the pump and of the operation of the known motor-driven radial piston pump assembly, reference can be made to U.S. Pat. No. 4,627,793, the entire disclosure of which is herewith incorporated specifically by reference.

The assembly according to the invention includes a base section generally designated 2 which serves to mount pump 1 together with all its connecting lines and control elements and an electric motor 4 which is operatively connected to the pump and is supported on the base section coaxially with respect to the central axis of motor output shaft 12 which lies along pump propulsion axis 3. The motor 4, typically a conventional DC motor, functions to operate pump 1. A hydraulic tank 5 is located on the same side of the base section as is the motor and likewise is coaxial with the motor and with axis 3 and is connected to the front side of base section 2.

A cylindrical covering 6 defines the outer wall of the hydraulic tank and is sealingly connected to the base section. The electric motor is likewise directly connected to the base section, so that all supporting and bearing forces and moments are carried by the base section which can therefore be constructed or used for the attachment (not shown) of the entire motor-driven radial piston pump assembly.

Similarly connected to the base section is a substantially cylindrical-shaped motor housing 7 which surrounds and encases the electric motor and which is sealingly connected to base section 2. The motor housing defines an inner wall of the hydraulic tank and is closed at its outer end opposite the pump end of the assembly by the provision of a cover 8.

Base section 2 comprises a pump support 9 which contains and receives pump 1 and all its connection lines and control elements, and further comprises a separate support flange 10 which is connected to a confronting side of motor 4 so as to thereby support the motor as well as motor housing 7 and hydraulic tank 5. The base section is therefore functionally divided and, for example, can be constructed of different materials.

Motor housing 7 surrounds outer periphery 11 of a cylindrical-shaped projection 13 of support flange 10 through which motor shaft 12 extends. Housing 7 is sealingly connected to projection 13 in some normal manner as by being pressed or swaged into a peripheral groove or grooves 14, 15.

The assembly according to the invention further includes an hydraulic suction line generally designated 16 leading to pump 1 from hydraulic tank 5, the suction line including a suction pipe 17 which extends into the tank and a feeder line 18 formed in pump support 9. The suction pipe is supported by support flange 10 so as to establish direct communication between feeder line 18 and the hydraulic tank.

Cover 8 closing the outer end of the motor housing is simply pressed into the outer edge of the housing, but may also be formed integrally with the motor housing.

Covering 6 forming the outer wall of the hydraulic tank bears against the outer periphery of the motor housing via an annular seal 18*a*. Cover 8 can also be connected outside of this sealing area (not shown) with a covering of the hydraulic tank and formed integrally therewith, if required, in order to close the inner area of the motor housing.

Electric components for the electric motor such as, for example, an interference or a temperature safeguard element in the form of a temperature protection switch or a high temperature conductor, are generally designated 19 and are skeptically shown in FIG. 1 as located on the outer end wall of the electric motor on the outer surface thereof opposite base section 2. This can prove advantageous as regards the required spacial proximity of such components to the electric motor.

Covering 6 of hydraulic tank 5 is sealingly connected to support flange 10 as the covering engages the outer periphery of support flange 10 and is sealingly connected thereto by the provision of an external annular seal collar 20 and secured in place by a removable hose clamp 21. Sealed connection between covering 6 and flange 10 is effected via a seal ring or the like which may be located in a peripheral groove 22. Further seal rings may be provided in grooves 23 between support flange 10 and pump support 9.

Electric motor 4 powers pump 1 by means of motor shaft 12 and a coupling 24. The construction and operation of a motor-driven radial piston pump is generally known in the art and is disclosed in detail in the aforementioned U.S. Pat. No. 4,627,793 patent to which reference may be made for details of that construction and operation. Thus, as known in the art the hydraulic fluid is discharged by the pump from a discharge port (not shown in FIG. 1) from which the hydraulic fluid is fed to a hydraulic device (not shown).

Figure 2:
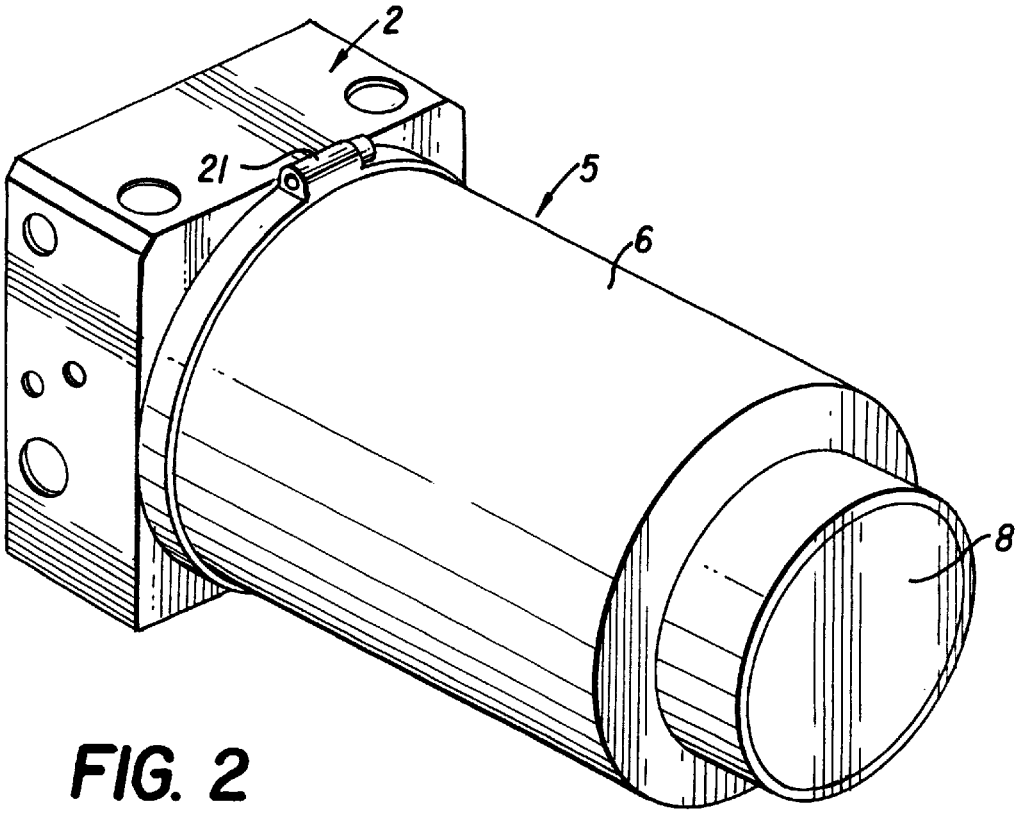
FIG. 2 is perspective view of the assembly according to FIG. 1.

The various hydraulic connections on pump support 9 are especially visible in FIG. 2 but are of no further relevance to the invention. It can be easily seen, especially when viewing FIG. 1, that covering 6 of the hydraulic tank supports nothing other than the hydraulic medium contained in the hydraulic tank during operation and therefore can be constructed of thin and light weight material, such as plastic material.

However, motor housing 7 can be formed of metallic material such as aluminum to enhance heat transfer from the electric motor to hydraulic tank 5 and to provide the necessary shielding.

The electrical supply to motor 4 which is not shown can be made through cover 8 either axially or radially, whereby no special sealing is required since the interior of motor housing 7 is dry relative to tank 5.

Finally a seal ring 25 may be provided at the free end of motor shaft 12 to seal against leakage of hydraulic medium into motor housing 7 from the pump area.

What is claimed is:

1. A motor-driven radial piston pump assembly comprising:

a radial piston pump with housing, hydraulic connection lines and control elements, functional parts of said pump are mounted and fixed in a separate base section, an electric motor operatively connected to the pump and supported on one side of the separate base section coaxially with respect to the central axis of a motor output shaft, the electric motor is connected directly to the base section, a substantially cylindrical-shaped motor housing separate from the electric motor itself surrounds and encases the electric motor and is sealingly connected to the base section, said motor housing defining an inner wall of an hydraulic tank, the separate remainder of said hydraulic tank is also supported on the one side of said separate base section coaxial to said axis, and a cover closing an outer end of only said motor housing opposite a pump end of the assembly.

2. The assembly according to claim 1, wherein the base section includes a pump support for the radial piston pump, the hydraulic connecting lines and the control elements, the base section further including a support flange secured to the electric motor, to the motor housing and to the hydraulic tank.

3. The assembly according to claim 2, wherein the support flange includes a cylindrical-shaped projection having a central opening through which the motor output shaft extends, the motor housing being sealingly secured about an outer periphery of said cylindrical-shaped projection.

4. The assembly according to claim 2, wherein the pump has an hydraulic suction line including a suction pipe extending into the tank and a feeder line located in the pump support, the suction pipe being supported by the support flange so as to establish communication between the feeder line and the tank.

5. The assembly according to claim 1, wherein the cover for closing the outer end the housing is formed integrally with the housing.

6. The assembly according to claim 1, wherein a covering defines an outer wall of said tank, said covering supporting said motor housing in surrounding sealed engagement therewith adjacent said cover which closes said outer end.

7. The assembly according to claim 1, wherein the electric motor has electric components including an interference element and a temperature safeguard element, the electric components being located within the motor housing at said outer end of said motor housing opposite said pump end.

8. The assembly according to claim 6, wherein the covering is sealingly and removably connected to the support flange about an outer periphery thereof.

9. A motor-driven radial piston pump assembly comprising:

a base section having a radial piston pump with hydraulic connecting lines and control elements, said base being an independent element;

an electric motor operatively connected to said pump and being supported on one side of said base section coaxially with respect to a central axis of a motor output shaft;

an hydraulic tank being supported on said one side of said base section coaxial to said central axis;

a substantially cylindrical-shaped motor housing, said housing being separate from said electric motor, said housing surrounding and encasing said electric motor and being sealingly connected to said base section;

said motor housing defining an inner wall of said hydraulic tank;

connecting means coupling said electric motor with said base section; and a cover closing an outer end of only said motor housing opposite a pump end of the assembly.

10. The assembly according to claim 9, wherein:

said base section comprising a pump support for said radial piston pump, said hydraulic connecting lines and said control elements; and said base section further including a support flange secured to said electric motor, to said motor housing and to said hydraulic tank.

11. The assembly according to claim 10, wherein:

said support flange comprises a cylindrical-shaped projection having a central opening through which said motor output shaft extends; and said motor housing sealingly secured about an outer periphery of said cylindrical-shaped projection.

12. The assembly according to claim 11, wherein:

said pump having an hydraulic suction line including a suction pipe extending into said tank from a hydraulic source outside said tank via a feeder liner located in said pump support; and said suction pipe being supported by said support flange so as to establish communication between said feeder line and said tank.

13. The assembly according to claim 12, wherein:

said cover for closing the outer end of said housing is integrally formed with said housing.

14. The assembly according to claim 13, wherein:

a covering defining an outer wall of said tank, said covering supporting said motor housing in surrounding sealed engagement therewith adjacent said cover which closes said outer end.

15. The assembly according to claim 14, wherein:

said electric motor having electric components including an interference element and a temperature safeguard element;

said electric components being located within said motor housing at said outer end of said motor housing opposite said pump end.

16. The assembly according to claim 15, wherein:

said covering is sealingly and removably connected to said support flange about an outer periphery thereof.

* * * * *